United States Patent [19]

Cook

[11] 4,134,369

[45] Jan. 16, 1979

[54] ARROW RELEASE MECHANISM AND ARROW NOCK THEREFOR

[76] Inventor: Thomas H. Cook, 1910 Cheyenne Dr., Scottsbluff, Nebr. 69361

[21] Appl. No.: 750,585

[22] Filed: Dec. 15, 1976

[51] Int. Cl.[2] ..... F41B 5/00; F41B 5/02

[52] U.S. Cl. ..... 124/35 A; 124/91; 273/106.5 C

[58] Field of Search ..... 124/35 A, 35 R, 41 A, 124/23 R, 24 R, 86, 90, 91

[56] References Cited

U.S. PATENT DOCUMENTS

| | | | |
|---|---|---|---|
| 1,542,159 | 6/1925 | Maxwell | 124/35 A |
| 2,488,597 | 11/1949 | Konold | 124/35 A |
| 2,819,707 | 1/1958 | Kayfes et al. | 124/35 A |
| 3,948,243 | 4/1976 | Gazzara | 124/35 A |

*Primary Examiner*—Richard C. Pinkham
*Assistant Examiner*—William R. Browne
*Attorney, Agent, or Firm*—Roylance, Abrams, Berdo & Farley

[57] ABSTRACT

An arrow release mechanism formed of only eight separate parts, such mechanism including a handle, a pair of opposed jaws pivotally coupled to the handle, and a trigger, pivotally coupled to the jaws, for releasing a locking assembly to thereby release a substantially spherical arrow nock grasped in substantially hemispherical sockets in the jaws. The pivotal coupling of the jaws and the handle together with the reception of the substantially spherical nock in the substantially hemispherical sockets provides a universal coupling between the arrow and the handle so that relative movement therebetween during aiming of the arrow will not mar the accuracy of the aiming.

15 Claims, 14 Drawing Figures

FIG. 7
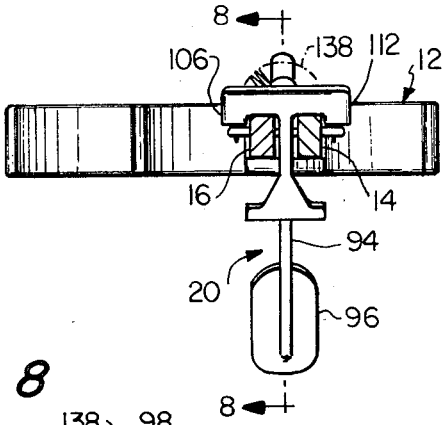
FIG. 12
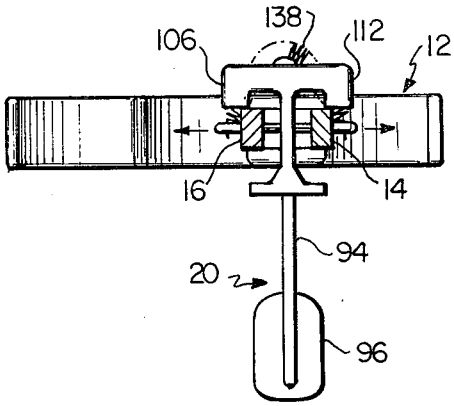
FIG. 8
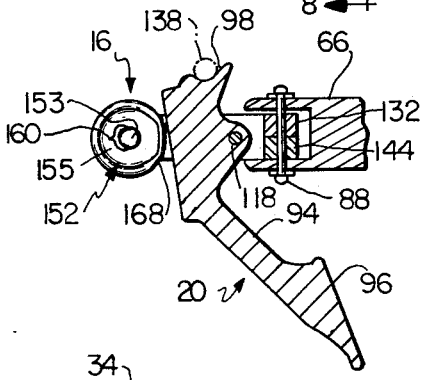
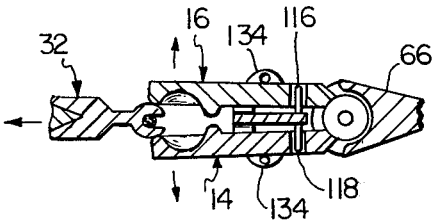
FIG. 13
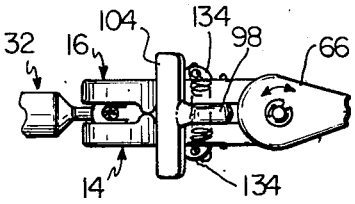
FIG. 10
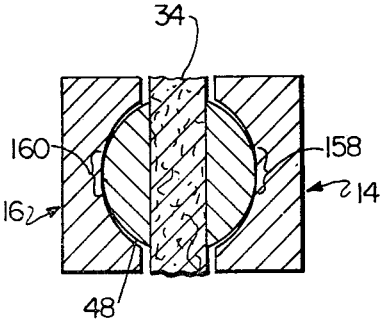
FIG. 14
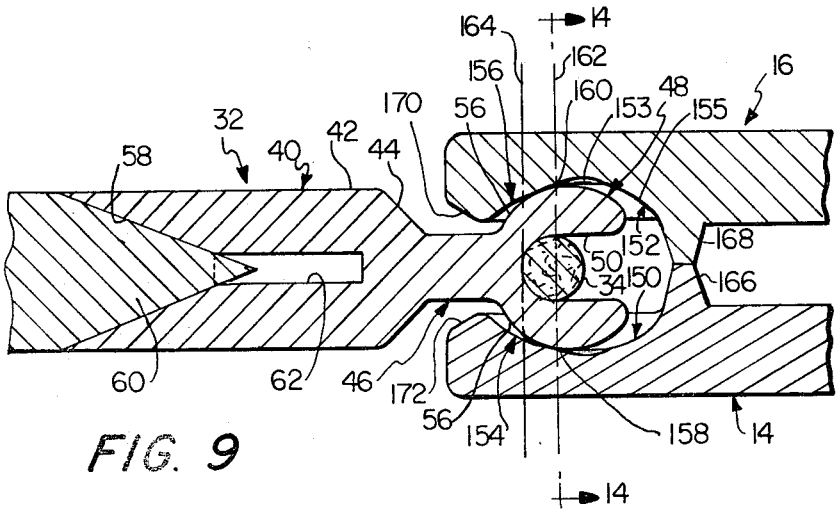
FIG. 9

ARROW RELEASE MECHANISM AND ARROW NOCK THEREFOR

The present invention relates to an arrow release mechanism and arrow nock therefor, and more particularly relates to a release mechanism formed of only eight separate parts having opposed lockable jaws with sockets therein for releaseably receiving a substantially spherical arrow nock.

Many prior art devices have been devised to mechanically grasp an arrow and bowstring combination so that the arrow can be pulled back, tensioned against the string and then mechanically released. The reason for this is the elimination of sore fingers caused by repetitive contact with a bowstring, elimination of a game scaring twang caused by fingers releasing the bowstring, and elimination of string deflection caused by fingers gripping the bowstring above and below the arrow, resulting in lower arrow velocity and accuracy.

However, most of the prior art release mechanisms have numerous shortcomings. For example, many directly grip the bowstring, resulting in frictional wear and ultimate destruction of the bowstring itself. In addition, many of these devices require springs of high force which ultimately causes flinching on release of the arrow resulting in a low accuracy shot. Moreover, numerous of these devices include a handle rigidly coupled to a tube into which the arrow nock is placed, thereby resulting in a rigid coupling between the arrow and the release mechanism. This rigid coupling allows any lateral movement of the device to transmit a corresponding lateral movement to the drawn arrow which results in a low accuracy shot. Additionally, in these prior art devices in which the arrow nock fits into a rigid tube, substantially right angled stops are provided on the nock and corresponding right angle stops are provided on pivotal jaws which results in a jerking release, with corresponding lost accuracy.

Finally, many of these prior art devices are formed of numerous parts requiring complicated manufacture, assembly and repair.

Accordingly, it is an object of the present invention to overcome the limitations and drawbacks associated with the aforesaid prior art devices and to provide a new and improved arrow release mechanism and arrow nock therefor.

Another object is to provide an arrow release mechanism which eliminates sore fingers, wear on bowstrings, and arrow twang on release.

Another object is to provide a release mechanism providing a high accuracy and high arrow velocity shot.

Another object is to provide a release mechanism which can utilize heavy draw-weight bows because the trigger mechanism does not require a strong spring.

Another object is to provide a release mechanism insuring a smooth release with no arrow deflection and no flinching by the shooter.

Another object is to provide a universal coupling between the arrow and the device so that relative movement therebetween during aiming of the arrow will not mar the accuracy of the aiming.

Another object is to provide a release mechanism which is formed of only eight separate parts, thereby providing ease of manufacture, assembly and repair.

SUMMARY OF THE INVENTION

These objects are generally attained by providing a substantially spherical arrow nock received in substantially hemispherical recesses or sockets in the mechanism's pivotal jaws. On release of a jaw locking device by manually activating a trigger, the tension of the bowstring pulls the nock from the jaws which are cammed open by the moving spherical arrow nock. This results in a very smooth, quiet release. Since the jaws grasp the nock, not the bowstring, deflection and abrasion of the bowstring are avoided. Additionally, the connection of the substantially spherical nock in the substantially hemispherical recesses together with a pivotal coupling of the jaws and the handle provides a universal coupling therebetween, so that lateral movement of the archer's hand will not cause a corresponding movement, and therefore misalignment, of the aimed arrow received in the jaws. Since the mechanism is formed of only eight separate parts, manufacture, assembly and repair is quite simple and inexpensive.

More specifically, the foregoing objects are attained by providing a hand-held arrow release mechanism for use with an arrow nock having a cam surface thereon facing the forward tip of the arrow, the arrow nock being coupled to the arrow which is received on a bowstring, the combination comprising a handle; a pair of opposed jaws, each having a recess on facing sides thereof, the forward portion of each recess being in the form of a cam follower surface corresponding to part of the cam surface on the nock; means for pivotally coupling the jaws to the handle; means, coupled to the jaws, for biasing the opposed jaws toward each other into a nock grasping position in which the cam surface portion of the nock contacts the cam follower surfaces of the recesses; locking means for locking the jaws together in the grasping position thereby locking the nock between the jaws; means for pivotally coupling the locking means to the jaws; and manually activated means, coupled to the locking means, for releasing the locking means thereby allowing the nock cam surface to move forward along the cam follower surfaces under the influence of the bowstring pulling on the nock so the jaws pivot outwardly of the grasping position releasing the nock and the arrow therefrom.

The arrow nock cam surface is provided by forming a substantially spherical portion at the rear end of the nock with a notch therein for reception of the bowstring. Additionally, the recesses in the jaws are substantially hemispherical for reception of the nock substantially spherical portion and the forward portions of the recesses form cam follower surfaces.

The manually activated means is a trigger pivotally coupled to the jaws and the locking means includes ears depending from the trigger and receivable over the jaws.

A spring coupled to the jaws and resting in a saddle portion on the trigger biases the jaws together and also biases the ears into the nock grasping locked position.

The universal coupling of the arrow relative to the handle, which is grasped by the archer, is provided by the pivotal coupling of the jaws and the handle about a vertical axis and the reception of the substantially spherical nock in the substantially hemispherical recesses about a horizontal axis, which axis is perpendicular to the jaws-handle vertical pivotal axis, and about another horizontal axis which runs along the longitudinal expanse of the mechanism from the forward portions of the jaws to the rear of the handle. In addition, there is also some relative pivotal movement between the nock and the recesses about a vertical pivotal axis, but this is somewhat limited, as to be hereinafter further described. In any event, by universally coupled it is specifically meant that the coupling provides relative pivotal movement between the specified parts about three axes at the same time, each axis being perpendicular to the other two.

Other objects, advantages and salient features of the present invention will become apparent from the following detailed description, which, taken in conjunction with the annexed drawings, discloses preferred embodiments of the present invention.

DRAWINGS

Referring now to the drawings which form a part of this original disclosure;

Figure 3:
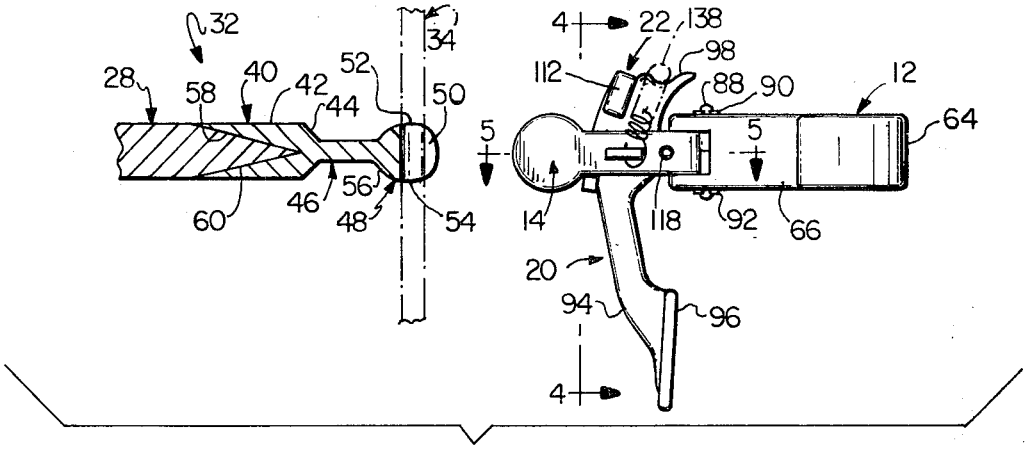
FIG. 3 is a side elevational view of the arrow release mechanism in which the jaws are in the opened position ready to receive a nock and also a side elevational view in longitudinal section of a nock receiving a bowstring.
Figure 11:
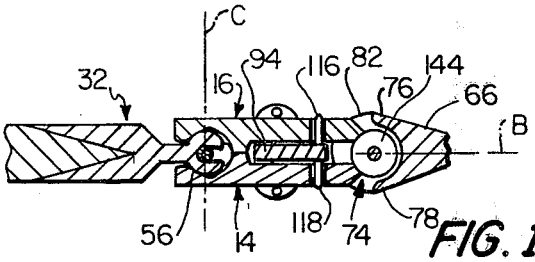
Figure 6:
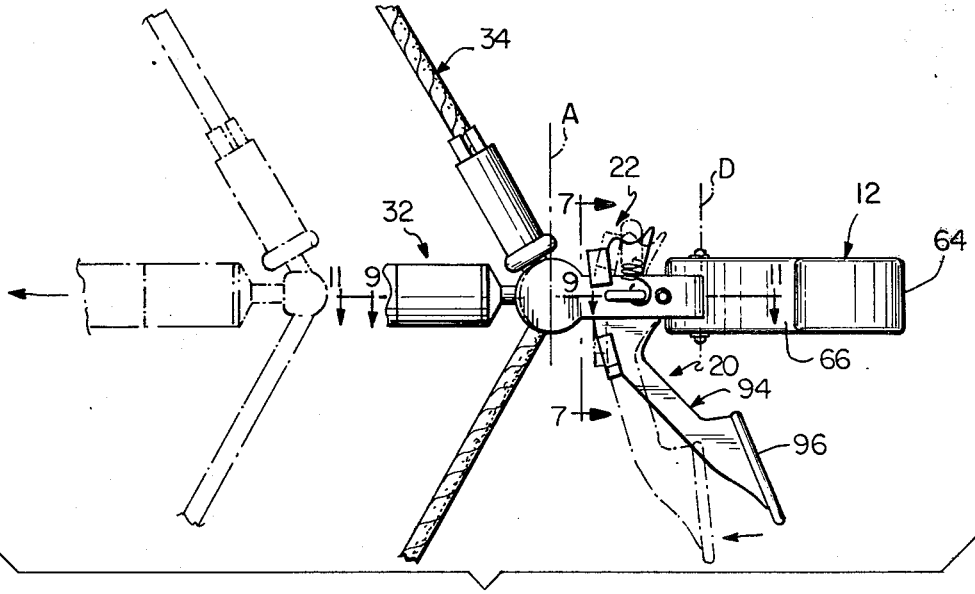

FIG. 6 is a side elevational view of the arrow release mechanism and arrow nock therefor shown in solid lines in which the locking ears lock the jaws together with the nock grasped therebetween and in phantom lines in which the locking ears no longer lock the jaws together since the trigger has been manually manipulated to the left as shown in FIG. 6 and the arrow nock, under the influence of the bowstring, pivots the jaws open and is released therefrom;

FIG. 7 is a left end view in section taken along lines 7—7 in FIG. 6 showing the arrow release mechanism in the locked position;

FIG. 8 is a side elevational view in section taken along lines 8—8 in FIG. 7 showing the arrow release mechanism in the locked position, however, the nock has not been shown for reasons of clarity;

FIG. 9 is an enlarged top plan view in section taken along lines 9—9 in FIG. 6 showing the precise reception of the arrow nock in the recesses of the jaws, with the interior of the nock being slightly modified from that shown in FIG. 3;

FIG. 10 is a fragmentary top plan view of the arrow release mechanism and arrow nock therefor shown in FIG. 6;

FIG. 11 is a fragmentary top plan view in section taken along lines 11—11 in FIG. 6 showing a nock received and locked in the recesses of the mechanism's jaws;

FIG. 12 is a left end view in section taken along the lines similar to 7—7 in FIG. 6 but showing the arrow release mechanism with the nock being released therefrom under the influence of the bowstring; and FIG. 13 is a top plan view in section taken along lines similar to 11—11 in FIG. 6 showing the nock on its release from the arrow release mechanism, such nock having cammed open the jaws of the release mechanism.

FIG. 14 is an elevational view in section taken along lines 14—14 in FIG. 9.

DETAILED DESCRIPTION OF THE INVENTION

Figure 1:
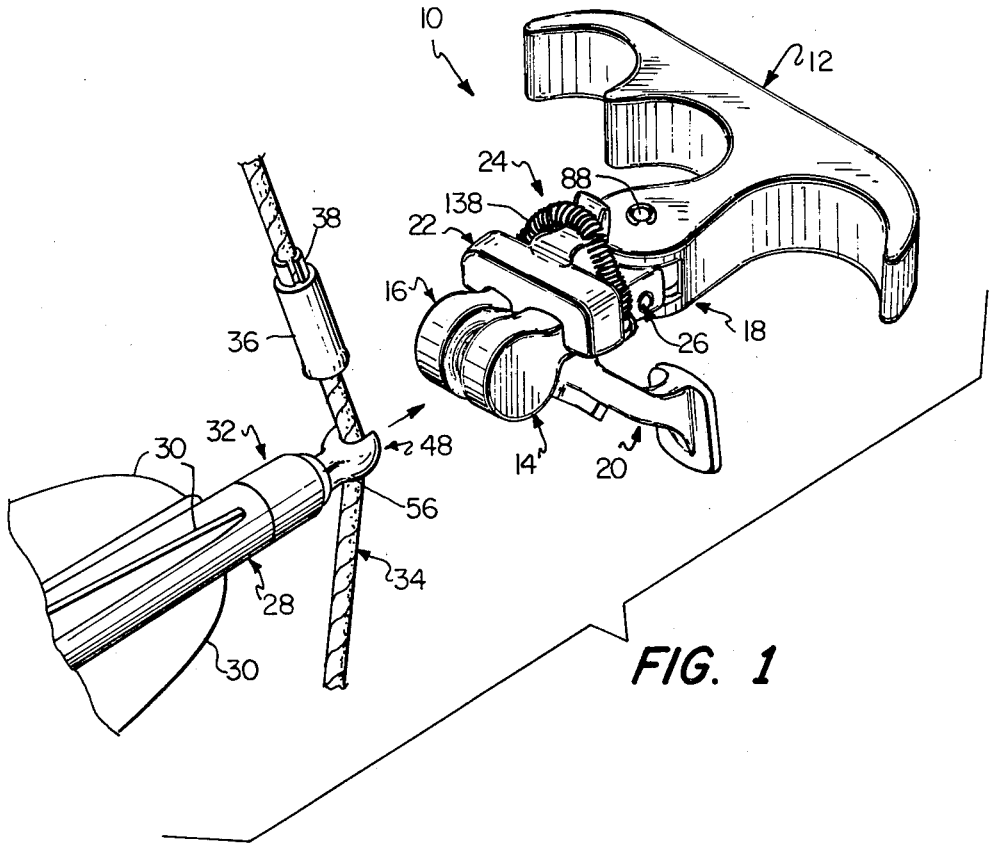
FIG. 1 is a perspective view of the arrow release mechanism and arrow nock therefor in accordance with the present invention.

Referring now to the drawings in further detail, as shown in FIG. 1, the arrow release mechanism 10 comprises a handle 12, a first jaw 14, a second jaw 16, a pivot assembly 18 for pivotally coupling the jaws to the handle, a manually activated trigger 20, a locking assembly 22 for locking the jaws together, a biasing assembly 24 for biasing the jaws together and biasing the locking assembly downwards, and a second pivot assembly 26 for pivotally coupling the trigger to the jaws.

Adjacent the arrow release mechanism 10 is an arrow 28 having fletching 30 thereon and a nock 32 received at the butt end of the arrow and engaging the bowstring 34. Located above the nock 32 is a rubber cylinder 36 rigidly positioned on the bowstring by means of a squeeze clamp 38 which helps to vertically center the release mechanism 10 relative to the bowstring.

Referring now to FIG. 3, the nock 32 is shown comprised of a first solid portion 40 having a cylindrical section 42 and a conical section 44, which conical section extends into a second cylindrical portion 46, which second portion 46 extends into a third substantially spherical portion 48. This third portion 48 has a vertical notch 50 therein for the reception of the bowstring 34 (as best seen in FIG. 9). The outer surface of the third portion 48 is substantially spherical in shape except that it has a somewhat flat top 52 and a flat bottom 54. As best shown in FIGS. 1, 9 and 11, the portions of the outer surface of the third portion 48 toward the forward end of the arrow adjacent the connection with second portion 46 forms a cam surface 56 which is rounded. The outer periphery, or diameter, of the third portion 48 is larger than the outer periphery, or diameter, of the second cylindrical portion 46.

Referring again to FIG. 3, the first solid portion 40 has a central, conical indentation 58 for the reception of the conical end 60 of arrow 28.

As shown in FIG. 9, the nock 32 first portion 40 is slightly modified by having a central cylindrical bore 62 extending from the apex of the conical indentation 58 to a position adjacent the end of the cylindrical section 42. As shown in FIG. 9, the very tip of the conical end 60 of arrow 28 extends slightly into the cylindrical bore 62. Since the arrow 28 is coupled to the nock 32 by means of an adhesive, the purpose of the cylindrical bore is to receive an overflow of such adhesive.

Figure 2:
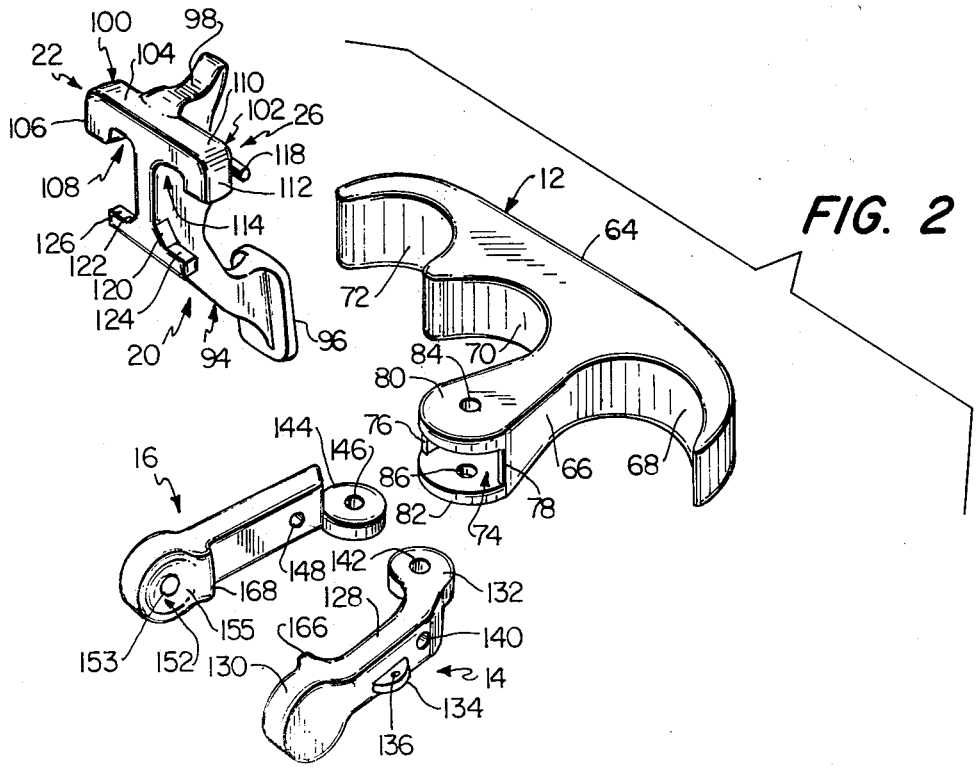
FIG. 2 is a perspective view of the various parts of the arrow release mechanism shown in their unconnected state without a jaws-handle connecting pin, without snap rings therefor and without the spring biasing mechanism.

Referring now to FIG. 2, the main components of the release mechanism 10 are shown as comprising the handle 12, the trigger 20, and the two opposed jaws 14 and 16.

Handle 12 includes a base portion 64 and an integrally formed laterally extending portion 66 which divides an index finger groove 68 on the base portion and a middle finger groove 70 on the base portion, the base portion also having a ring finger groove 72 at the end thereof. Preferably, the archer grasps the handle 12 with the recited fingers between the first and second knuckles thereon.

The laterally extending portion 66 includes at the end thereof an indentation 74, also seen well in FIG. 11, such indentation being bounded by side walls 76 and 78 and by top and bottom extensions 80 and 82 integrally formed with the lateral extending portion 66. These top and bottom extensions 80 and 82 have respectively therein vertically aligned apertures 84 and 86 for the reception of a vertical pivot pin 88, shown in FIGS. 1 and 3. This pin 88 is held in place by top and bottom snap rings 90 and 92, as shown in FIG. 3. The relative pivotal movement of the jaws 14 and 16 and handle 12 about pin 88 is limited by contact of the respective jaw with side wall 78 or 76.

Referring again to FIG. 2, the manually activated trigger 20 has an elongated central member 94, which is curved and has a thumb plate 96 at the bottom thereof. At the top, the central member 94 carries a curvilinear saddle portion 98, which is also clearly shown in FIG. 3. Adjacent the saddle portion and slightly forward thereof on the central member 94 is the locking assembly 22. This locking assembly comprises two locking ears 100 and 102, each of which extends transversely from an opposite side of central member 94. Thus locking ear 100 is formed from a transversely extending top portion 104 and a downwardly extending side portion 106 which is spaced from the side of the central member 94 forming a slot 108 therebetween. Similarly locking ear 102 has a top portion 110 and a side portion 112 spaced from the central member 94 thereby forming a slot 114 therebetween. Jaws 14 and 16 are respectively received in slots 114 and 108 to lock the jaws closed, which is shown in FIG. 1.

Figure 5:
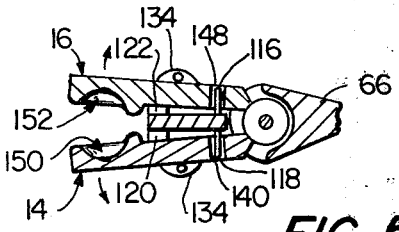
FIG. 5 is a top plan view in section taken along lines 5—5 in FIG. 3.

To the rear of the central member 94 as shown in FIGS. 2, 3 and 5, a pivot assembly 26 for the trigger 20 is formed by two pins 116 and 118 extending transversely from the sides of the central member 94 somewhat below the lowermost portions of the ears 100 and 102.

As shown in FIG. 2 spaced below the locking ears 100 and 102 on the forward portion of central member 94 is a first cam 122 and a second cam 120, each of which is basically an inclined plane extending from the central member at an angle of about 45°, each of which terminates in a flat stop surface, stop surface 126 being associated with the first cam 122 and stop surface 124 being associated with the second cam 120. These surfaces are in the same plane which is essentially perpendicular to the vertical axis of the central member 94.

The opposed jaws 14 and 16 are shown in FIG. 2 and are identical so only one will be described in specific detail. Thus the first jaw 14 is comprised of an elongated main portion 128 being substantially rectangular in cross section, a forward rounded portion 130 and a rear lug portion 132.

Located on the outside surface substantially midway along the elongated main portion 128 is a lug 134 having an aperture 136 therein for the reception of one end of the spring 138 shown in FIGS. 1 and 3 and comprising the biasing assembly 24. Slightly rearward of lug 134 is an aperture 140 passing completely through jaw 14 and having a horizontal longitudinal axis. This aperture 140 has an inner diameter slightly larger than the outer diameter of cylindrical pin 118, such pin 118 being pivotally receivable in aperture 140 and also being slidably movable in the longitudinal direction of the axis of the aperture 140.

Rear lug portion 132 is rounded and extends downwardly only one half the height of the elongated main portion 128 at the end thereof, such rear lug portion having a vertical, central aperture 142 therein for the reception of pin 88, thereby pivotally mounting jaw 14 to handle 12.

Referring now to FIGS. 2 and 5, the second jaw 16 has a rear lug portion 144 with a central aperture 146, which rear lug portion is similar to rear lug portion 132 on the first jaw 14, except it is on the bottom half of the jaw. In addition, the second jaw 16 has a transverse aperture 148 similar to aperture 140 in the first jaw 14, this aperture 148 receiving, as shown in FIG. 5, pin 116 extending from the central member 94. Once again, the pin is pivotally and longitudinally slideable in the aperture.

Referring now to FIGS. 2 and 9, each of the opposed jaws 14 and 16 has the forward rounded portion which contains a substantially hemispherical recess, with jaw 14 having recess 150 and jaw 16 having recess 152. While substantially hemispherical, each of these recesses are in a shape formed by the intersection of two hemispheres 153 and 155 having different radii. The radius of hemisphere 153 is slightly smaller than that of hemisphere 155, the former being located at the center of the latter as shown in FIG. 8. As an example, with a spherical nock portion 48 radius of 5/32 inch, the radius of hemisphere 155 is advantageously 6/32 inch and the radius of hemisphere 153 is advantageously 5/32 inch. The forward portion of each of recesses 150 and 152 forms a cam follower surface, which is rounded, surface 154 being associated with recess 150 and surface 156 being associated with recess 152.

Each of these cam follower surfaces correspond to and will ultimately have relative movement with the cam surface 56 on the third substantially spherical portion 48 of the nock 32.

As shown in FIGS. 8, 9 and 14, the cam follower surfaces 154 and 156 on the recesses contact the cam surface 56 at two curved lines along the forward portion of the intersection of hemispheres 153 and 155 while the jaws 14 and 16 are in the grasping position shown in FIG. 9 and these two curved lines generally designated 158 and 160 lie in a curved surface the most forward portion of which is tangent to a plane designated 162 which is closer to the handle 12 than the vertical plane 164 containing the line contact of the bowstring 34 with the inside end of the notch 50 in which the bowstring is received. Such a relationship provides a self centering interaction between the cam surface and the cam follower surfaces during the aiming process and as the nock is pulled from the recesses in which it is initially grasped.

As shown in FIGS. 2 and 9, jaw 14 has an abutment 166 and jaw 16 has an abutment 168 adjacent the rear of the associated recesses and which protrude inwardly from adjacent faces of the two jaws to establish a minimum spacing between the jaws when they are in the closed, grasping position shown in FIG. 9.

As also shown in FIG. 9, the forward ends of jaws 14 and 16 are bevelled inwardly at 172 and 170, respectively, so that there can be limited pivotal movement around an axis A shown in FIG. 6 passing through the bowstring 34 of the nock 32 relative to the jaws 14 and 16, such movement being limited by contact of member 46 with bevelled edges 170 and 172. In addition, since the third portion 48 of the nock 32 is substantially spherical and the recesses 150 and 152 are substantially hemispherical, limited pivotal motion is allowable between the nock and the recesses about an axis B shown in FIG. 11 extending longitudinally along the release mechanism 10, such motion being limited by contact of the bowstring 34 with the jaws; and also along a horizontal axis C shown in FIG. 11 perpendicular to that longitudinal axis. Thus, there is a limited universal coupling provided by the substantially spherical portion of the nock and the substantially hemispherical recesses in the jaws. Of course, this universal coupling is assisted by means of the pivotal coupling of jaws 14 and 16 to handle 12 via pin 88, described above, resulting in pivotal movement about axis D shown in FIG. 6.

ASSEMBLY OF THE RELEASE MECHANISM

In order to assemble the release mechanism 10, the rear lug portions 132 and 144 on jaws 14 and 16 are superimposed so that apertures 142 and 146 align with each other and then these lugs are interposed into indentation 74 so their apertures align with apertures 84 and 86 and pin 88 is maneuvered through all of these four aligned apertures. Snap rings 90 and 92 are then coupled to opposite ends of pin 88 as shown best in FIG. 3. Thus, jaws 14 and 16 are pivotally coupled to the handle 12 insofar as they both can pivot relative to handle 12 and they can also pivot relative to each other.

Next, jaws 14 and 16 are spread apart and trigger 20 is maneuvered so that pins 118 and 116 thereon are aligned with apertures 140 and 148 in jaws 14 and 16, which jaws are then closed with these pins being slidably received in their respective aperture.

Finally, spring 138 has its opposite ends affixed to the two lugs 134 via reception in apertures 136 on the outside portions of the two opposed jaws 14 and 16, as best seen in FIGS. 5 and 10, and the midportion thereof placed in saddle 98 on stretching of the spring, as best seen in FIGS. 1 and 3.

Thus, it is clearly seen that the release mechanism 10 is formed of only eight separate parts and these are simply and easily assembled to form the working mechanism.

OPERATION

In operation of the release mechanism, the archer grasps handle 12 with his index, middle and ring fingers fitting into the corresponding index finger groove 68, middle finger groove 70 and ring finger groove 72.

Figure 4:
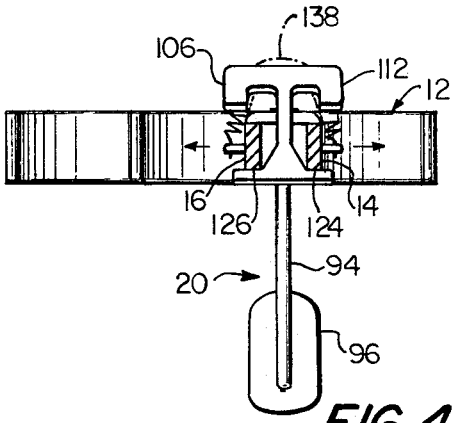
FIG. 4 is a left end view in section taken along lines 4—4 in FIG. 3.

Then the archer's thumb moves thumb plate 96 forward as shown in FIGS. 3, 4 and 5 which results in two things. First, side portions 106 and 112 of locking ears 100 and 102 move upward from the position shown in FIG. 1 to a position shown in FIG. 3 so that slots 108 and 114 no longer receive jaws 16 and 14 so that these jaws can be cammed open. Thus, the second thing occurs which is the camming open of the jaws 16 and 14 by means of first and second cams 122 and 120 which move upwards on pivoting of trigger 20 and act on the bottom surfaces of jaws 14 and 16, as shown most clearly in FIG. 4. This camming action and the opening of the jaws is halted when the stop surfaces 124 and 126 contact the bottom of the jaws, as also shown in FIG. 4. Thus, as shown in FIGS. 3, 4 and 5, the jaws 14 and 16 are fully open and ready to receive the spherical portion 48 of nock 32 which has already received a bowstring 34 in the notch 50 therein.

Of course, as thumb plate 96 is pushed forward, or to the left as viewed in FIG. 3, the trigger 20 pivots by having pins 116 and 118 pivot in apertures 148 and 140 in jaws 16 and 14, as shown in FIG. 5. In addition to pivoting in these apertures, there is also relative slidable movement therebetween as the jaws open. This pushing movement is against the force of spring 138 which tends to keep trigger 20 in the FIG. 1 position, i.e., with the locking ears engaging the jaws, which spring also tends to bias the jaws together.

Once the substantially spherical portion 48 of the arrow nock 32 is interposed between recesses 150 and 152 of the opposed jaws 14 and 16, pressure on thumb plate 96 is released and spring 138, received in saddle portion 98 of trigger 20, biases trigger 20 into a counterclockwise pivoting motion as viewed in FIG. 3 so that it moves to a position shown in solid lines in FIG. 6. In this position, jaws 16 and 14 are received respectively in slots 108 and 114 so that the locking ears 100 and 102 prevent outward movement of the jaws, thereby locking portion 48 of the nock 32 in the recesses 150 and 152, as shown in FIG. 9 most clearly. This position is also shown in FIGS. 7, 10 and 11.

At this point, the archer holding the bow with one hand pulls back on the arrow release mechanism 10 with the other hand, such mechanism grasping the arrow via the nock, and takes aim. During such aiming, handle 12 would be generally horizontal to the ground. However, the handle can be oriented at a different angle if indentation 74 were varied relative to axis B shown in FIG. 11.

In addition, during such aiming of the arrow, relative movement between the handle 12 and the locked jaws 14 and 16 is possible via the pivotal connection with pin 88 so that slight relative movement between the archer's arm or hand grasping the handle 12 and the arrow will not mar this aiming procedure. Furthermore, the substantially spherical portion of nock 32 being received in the substantially spherical recesses on the jaws 14 and 16 in addition adds a universal coupling therebetween so that relative motion between jaws 14 and 16, and handle 12, and nock 32 will also not significantly mar the aiming process.

Once aim has been taken, the archer once again presses thumb plate 96 forward to a position shown in phantom in FIG. 6. Such a pushing motion once again causes clockwise pivoting of trigger 20 to a position shown in FIGS. 12 and 13 in which the lowermost portion of side portions 106 and 112 of locking ears 100 and 102 are just above the top portions of jaws 16 and 14 which unlocks the jaws. Such unlocking allows the nock cam surface 56 to move forward along the cam follower surfaces 154 and 156 under the influence of the tensioned bowstring pulling the nock so that the jaws 14 and 16 pivot outwardly of the grasping position releasing the nock and the arrow therefrom, such releasing position being shown in FIG. 13 with the nock spherical portion 48 just about to be released from the jaws 14 and 16 which are moving outwardly under the camming action of the nock.

Once the arrow has been released from mechanism 10, the archer may release the thumb pressure on thumb plate 96 at which time spring 138 biases jaws 14 and 16 together and also biases trigger 20 to rotate in a counterclockwise pivotal movement as shown in FIG. 6 so that the mechanism returns to its initial position shown in FIG. 1 in which the jaws are locked together.

While one advantageous embodiment of the arrow release mechanism in accordance with the present invention and two advantageous embodiments of the arrow nock therefor have been chosen to illustrate the basic invention, it will be understood by those skilled in the art that various changes and modifications can be made therein without departing from the scope of the invention as defined in the appended claims.

What is claimed is:

1. A hand-held arrow release mechanism for use in combination with an arrow having an arrow nock with a cam surface thereon facing the forward tip of the arrow, the arrow nock being coupled to the arrow and received on a bowstring, the release mechanism comprising:

a handle;

a pair of opposed jaws, each having a recess on facing sides thereof, the forward portion of each recess being in the form of a cam follower surface corresponding to part of the cam surface on the nock;

means for pivotally coupling said jaws to said handle;

means, coupled to said jaws, for biasing said opposed jaws toward each other into a nock grasping position in which the cam surface portion of the nock contacts the cam follower surfaces of the recesses;

locking means, for locking said jaws together in the grasping position thereby locking the nock between said jaws;

means for pivotally coupling said locking means to said jaws; and manually activated means, coupled to said locking means for releasing said locking means thereby allowing the nock cam surface to move forward along said cam follower surfaces under the influence of the bowstring pulling on the nock so said jaws are pivoted outwardly of the grasping position by the moving nock cam surface, thereby releasing the nock and arrow therefrom.

2. A mechanism according to claim 1, wherein said manually activated means comprises a central member and two pins coupled thereto, each pin extending transversely from a side thereof, said jaws each having a bore therein receiving one of said pins for pivotal movement.

3. A mechanism according to claim 2, wherein said means for pivotally coupling said locking means to said jaws comprises said pins.

4. A mechanism according to claim 1, wherein said means for pivotally coupling said jaws comprises an aperture in portions of each of said jaws, at least one aperture in said handle, and a pin passing through all of said apertures.

5. A mechanism according to claim 4, wherein said handle includes means for limiting the pivotal movement of said jaws relative to said handle.

6. A mechanism according to claim 1, wherein said means for biasing comprises a spring coupled to said jaws.

7. A mechanism according to claim 1, wherein the nock has a notch therein receiving the bowstring and, said cam follower surfaces on said recesses contact the cam surface on the nock at two curved lines while said jaws are in the grasping position, said contact lines lying in a curved surface closer to said handle than the vertical plane containing the line contact of the bowstring with the end of the notch.

8. A mechanism according to claim 1, wherein said jaws include abutment means, protruding inwardly from adjacent faces of said jaws adjacent said recesses, for establishing a minimum spacing between said jaws in the grasping position.

9. A hand-held arrow release mechanism for use in combination with an arrow having an arrow nock with a cam surface thereon facing the forward tip of the arrow, the arrow nock being coupled to the arrow and received on a bowstring, the release mechanism comprising:

a handle;

a pair of opposed jaws, each having a recess on facing sides thereof, the forward portion of each recess being in the form of a cam follower surface corresponding to part of the cam surface on the nock;

means for pivotally coupling said jaws to said handle;

means, coupled to said jaws, for biasing said opposed jaws toward each other into a nock grasping position in which the cam surface portion of the nock contacts the cam follower surfaces of the recesses;

locking means, for locking said jaws together in the grasping position thereby locking the nock between said jaws;

means for pivotally coupling said locking means to said jaws; and manually activated means, coupled to said locking means, for releasing said locking means thereby allowing the nock cam surface to move forward along said cam follower surfaces under the influence of the bowstring pulling on the nock so said jaws are pivoted outwardly of the grasping position by the moving nock cam surface, thereby releasing the nock and arrow therefrom, wherein said manually activated means comprises a central member and two pins coupled thereto, each pin extending transversely from a side thereof, said jaws each having a bore therein receiving one of said pins for pivotal movement, wherein said locking means comprises a pair of ears coupled on opposite sides of said central member and having portions spaced from said central member defining slots therebetween, said jaws being receivable in said slots when said jaws are in the grasping postion.

10. A mechanism according to claim 9, wherein said means for biasing comprises a spring coupled to said jaws, and said central member has a saddle portion receiving said spring to bias said ears toward said jaws.

11. A hand-held arrow release mechanism for use in combination with an arrow having an arrow hock with a cam surface thereon facing the forward tip of the arrow, the arrow nock being coupled to the arrow and received on a bowstring, the release mechanism comprising:

a handle;

a pair of opposed jaws, each having a recess on facing sides thereof, the forward portion of each recess being in the form of a cam follower surface corresponding to part of the cam surface on the nock;

means for pivotally coupling said jaws to said handle;

means, coupled to said jaws, for biasing said opposed jaws toward each other into a nock grasping position in which the cam surface portion of the nock contacts the cam follower surfaces of the recesses;

locking means, for locking said jaws together in the grasping position thereby locking the nock between said jaws;

means for pivotally coupling said locking means to said jaws; and manually activated means, coupled to said locking means, for releasing said locking means thereby allowing the nock cam surface to move forward along said cam follower surfaces under the influence of the bowstring pulling on the nock so said jaws are pivoted outwardly of the grasping position by the moving nock cam surface, thereby releasing the nock and arrow therefrom, wherein said means for pivotally coupling said jaws comprises an aperture in portions of each of said jaws, at least one aperture in said handle, and a pin passing through all of said apertures, wherein said handle includes means for limiting the pivotal movement of said jaws relative to said handle, wherein said means for limiting includes an indentation formed in said handle into which those portions of said jaws containing said apertures are received, said indentation having side walls contacting said jaws after predetermined pivotal movement thereof relative to said walls, said handle including top and bottom extensions located above and below said indentation, each of said extensions having an aperture therein for receiving said pin.

12. A hand-held arrow release mechanism for use in combination with an arrow having an arrow nock with a cam surface thereon facing the forward tip of the arrow, the arrow nock being coupled to the arrow and received on a bowstring, the release mechanism comprising a handle;

a pair of opposed jaws, each having a recess on facing sides thereof, the forward portion of each recess being in the form of a cam follower surface corresponding to part of the cam surface on the nock;

means for pivotally coupling said jaws to said handle;

means, coupled to said jaws, for biasing said opposed jaws toward each other into a nock grasping position in which the cam surface portion of the nock contacts the cam follower surfaces of the recesses;

locking means, for locking said jaws together in the grasping position thereby locking the nock between said jaws;

means for pivotally coupling said locking means to said jaws;

manually activated means, coupled to said locking means, for releasing said locking means thereby allowing the nock cam surface to move forward along said cam follower surfaces under the influence of the bowstring pulling on the nock so said jaws are pivoted outwardly of the grasping position by the moving nock cam surface, thereby releasing the nock and arrow therefrom; and means, coupled to said jaws, for moving said jaws open to readily receive the nock therebetween.

13. A mechanism according to claim 12, wherein said manually activated means comprises a central member pivotally coupled to said jaws and said means for moving comprises a cam coupled to said central member and movable into a camming relationship with said jaws.

14. A hand-held arrow release mechanism for use in combination with an arrow having an arrow nock with a cam surface thereon facing the forward tip of the arrow, the arrow nock being coupled to the arrow and received on a bowstring, the release mechanism comprising:

a handle;

a pair of opposed jaws, each having a recess on facing sides thereof, the forward portion of each recess being in the form of a cam follower surface corresponding to part of the cam surface on the nock;

means for pivotally coupling said jaws to said handle;

means, coupled to said jaws, for biasing said opposed jaws toward each other into a nock grasping position in which the cam surface portion of the nock contacts the cam follower surfaces of the recesses;

locking means, for locking said jaws together in the grasping position thereby locking the nock between said jaws;

means for pivotally coupling said locking means to said jaws; and manually activated means, coupled to said locking means, for releasing said locking means thereby allowing the nock cam surface to move forward along said cam follower surfaces under the influence of the bowstring pulling on the nock so said jaws are pivoted outwardly of the grasping position by moving nock cam surface, thereby releasing the nock and arrow therefrom, wherein each of said recesses is substantially hemispherical in shape.

15. A hand-held arrow release mechanism for use in combination with an arrow having an arrow nock with a cam surface thereon facing the forward tip of the arrow, the arrow nock being coupled to the arrow and received on a bowstring, the release mechanism comprising:

a handle;

a pair of opposed jaws, each having a recess on facing sides thereof, the forward portion of each recess being in the form of a cam follower surface corresponding to part of the cam surface on the nock;

means for pivotally coupling said jaws to said handle;

means, coupled to said jaws, for biasing said opposed jaws toward each other into a nock grasping position in which the cam surface portion of the nock contacts the cam follower surfaces of the recesses;

locking means, for locking said jaws together in the grasping position thereby the nock between said jaws;

means for pivotally coupling said locking means to said jaws; and manually activated means, coupled to said locking means, for releasing said locking means thereby allowing the nock cam surface to move forward along said cam follower surfaces under the influence of the bowstring pulling on the nock so said jaws are pivoted outwardly of the grasping position by moving nock cam surface, thereby releasing the nock and arrow therefrom, wherein each of said recesses has a shape formed by the intersection of two hemispheres having different radii.

* * * * *

UNITED STATES PATENT OFFICE

CERTIFICATE OF CORRECTION

PATENT NO. : 4,134,369

DATED : Jan. 16, 1979

INVENTOR(S) : Thomas H. Cook

It is certified that error appears in the above-identified patent and that said Letters Patent are hereby corrected as shown below:

Column 9, line 24, before "for" insert --,--.
Column 10, line 44, change "hock" to --nock--.
Column 11, line 26, after "prising" add --:--.
Column 12, line 46, after "thereby" add --locking--.

Signed and Sealed this

*First* Day of *May 1979*

[SEAL]

*Attest:*

RUTH C. MASON
*Attesting Officer*

DONALD W. BANNER
*Commissioner of Patents and Trademarks*